US010731801B1

(12) United States Patent
Hofer

(10) Patent No.: US 10,731,801 B1
(45) Date of Patent: Aug. 4, 2020

(54) FLASHLIGHT

(71) Applicant: Steven Hofer, Calgary (CA)

(72) Inventor: Steven Hofer, Calgary (CA)

( * ) Notice: Subject to any disclaimer, the term of this patent is extended or adjusted under 35 U.S.C. 154(b) by 0 days.

(21) Appl. No.: 16/527,695

(22) Filed: Jul. 31, 2019

(51) Int. Cl.

| | |
|---|---|
| ***F41G 1/34*** | (2006.01) |
| ***F21L 4/00*** | (2006.01) |
| ***F21V 15/01*** | (2006.01) |
| ***F21L 4/02*** | (2006.01) |
| ***F21V 5/00*** | (2018.01) |
| ***F21V 23/04*** | (2006.01) |
| ***F21V 23/02*** | (2006.01) |
| *F21Y 115/10* | (2016.01) |
| *F21Y 103/33* | (2016.01) |

(52) U.S. Cl.
CPC ..... *F21L 4/005* (2013.01); *F21L 4/027* (2013.01); *F21V 5/006* (2013.01); *F21V 15/01* (2013.01); *F21V 23/02* (2013.01); *F21V 23/0414* (2013.01); *F21Y 2103/33* (2016.08); *F21Y 2115/10* (2016.08)

(58) Field of Classification Search
CPC ..... F21L 4/00–085; F21V 5/006; F21V 15/01–015; F21V 23/00–0428
USPC ..... 362/110–114, 183–208, 253, 458
See application file for complete search history.

(56) References Cited

U.S. PATENT DOCUMENTS

| | | | |
|---|---|---|---|
| 3,539,798 | A | 11/1970 | Perry |
| 5,101,333 | A | 3/1992 | Glassford |
| 5,461,552 | A | 10/1995 | Tillery |
| D442,329 | S | 5/2001 | Najar et al. |
| 6,366,028 | B1 | 4/2002 | Wener et al. |
| 6,746,124 | B2 | 6/2004 | Fischer et al. |
| 7,954,978 | B2 | 6/2011 | Sharrah et al. |
| 8,905,562 | B1 | 12/2014 | Ghionis |
| 2006/0198132 | A1 | 9/2006 | Trigiani et al. |
| 2012/0140467 | A1 | 6/2012 | Chang |

*Primary Examiner* — Jason M Han
(74) *Attorney, Agent, or Firm* — Argus Intellectual Enterprise; Daniel Enea; Jordan Sworen

(57) ABSTRACT

A flashlight for the illumination of an object and viewing the object through the flashlight. The flashlight includes a housing having an inner side forming a channel that extends between a first end of the housing and a second end of the housing. The flashlight includes one or more light sources that are able to emit light therefrom and at a desired target. A power supply is operably connected to a control such that they operate the one or more lights. The inner side of the housing extends past a forwardmost edge of an outer side of the housing at the second end to form a shoulder. The shoulder extends about the housing and, in one embodiment, the one or more lights are disposed thereon. In this way, the one or more lights directly illuminate a target without causing shadows to form from the viewing perspective.

15 Claims, 2 Drawing Sheets

FLASHLIGHT

BACKGROUND OF THE INVENTION

The present invention relates to a flashlight. More specifically, the present invention relates to a flashlight having a channel extending therethrough that provides a viewing perspective of a target.

Conventional flashlights are designed to be powered by batteries installed within a barrel of the flashlight rearwardly of the light source. This placement of the batteries with respect to the light source, generally forms an enclosed housing that can be handled and the light source directed as desired. The problem, however, is that when the target is viewed by a user, the light source of the flashlight and the viewing perspective are naturally offset from each other. For example, in the event the target of the light source is positioned in a tight space, or positioned behind one or more intervening objects, the target is often poorly illuminated with respect to the viewing perspective. Although the conventional flashlight provides some light directed at the target, the intervening objects will cause a shadow on the target.

In addition to conventional flashlights failing to provide a channel for viewing the target, these devices also fail to include a shoulder adapted to minimize ambient light and light emitted from the one or more light sources from entering the channel. Allowing light to enter the channel from which a user is viewing obstructs vision and reduces the overall efficacy of the flashlight.

In view of the above concerns, it is desirable to provide an embodiment of the flashlight that includes a channel for viewing that target wherein the one or more light sources are positioned about the channel. Particularly, it is desirable to provide the flashlight having a shoulder where the one or more lights are positioned, wherein the shoulder extends annularly about the second end of the housing.

In light of the devices disclosed in the known art, it is submitted that the present invention substantially diverges in design elements and methods from the known art and consequently it is clear that there is a need in the art for an improvement for a flashlight. In this regard the instant invention substantially fulfills these needs.

SUMMARY OF THE INVENTION

In view of the foregoing disadvantages inherent in the known types of flashlights now present in the known art, the present invention provides a new flashlight wherein the same can be utilized for illuminating and viewing a target without the creation of shadows that may otherwise make viewing the target difficult.

It is an objective of the present invention to provide a flashlight including a housing having an inner side forming a channel that extends between a first end of the housing and a second end of the housing. The flashlight includes one or more light sources that are adapted to emit light therefrom and at a desired target. A power supply housing and power supply are located on the housing and a control is operably connected to a power supply. The inner side of the housing extends past a forwardmost edge of an outer side of the housing at the second end to form a shoulder. The shoulder extends about the housing and in one embodiment, the one or more lights are disposed thereon.

In one embodiment, the inner side of the housing includes a circular cross section and the channel has a uniform diameter between the first and second end.

In an alternative embodiment, a lens is disposed within the channel to provide enhanced viewing of the target.

In yet another embodiment, the channel is tapered to provide a wider or narrower view of the target from the viewing perspective.

It is therefore an object of the present invention to provide a new and improved flashlight that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
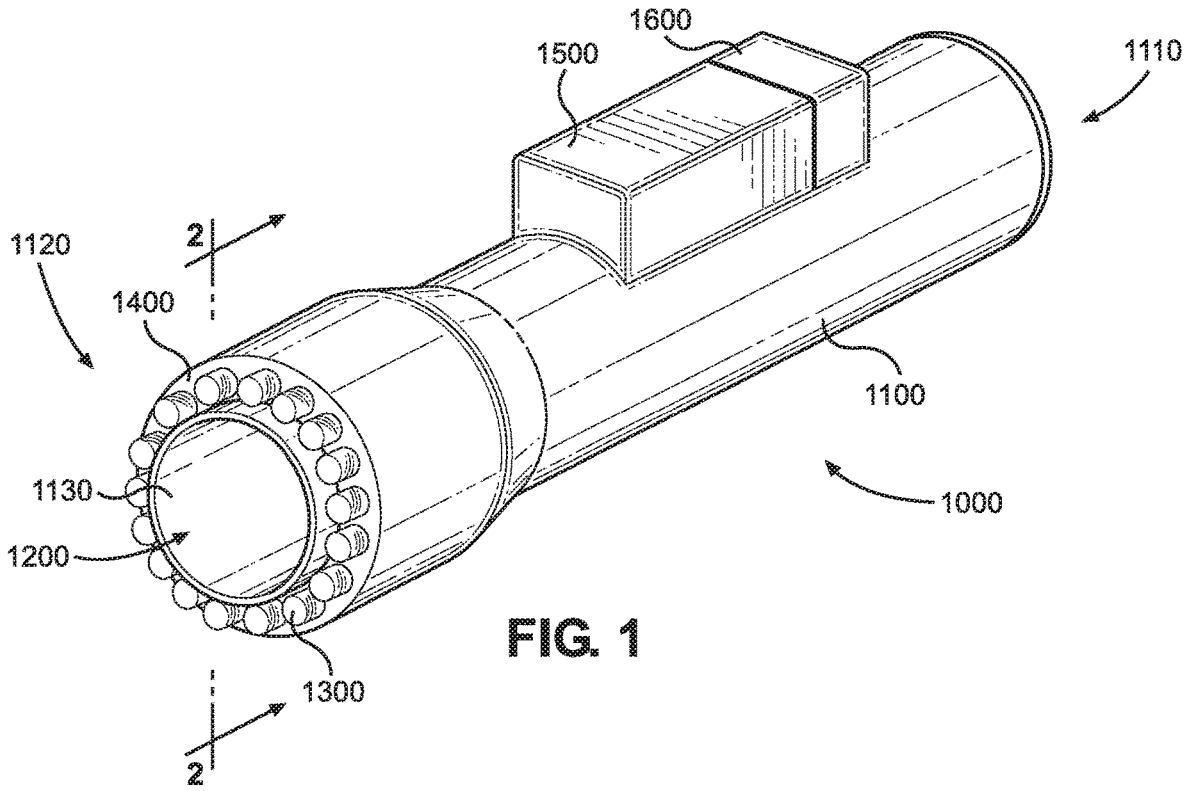
FIG. 1 shows a perspective view of a first embodiment of the flashlight.

Reference is made herein to the attached drawings. Like reference numerals are used throughout the drawings to depict like or similar elements of the flashlight. For the purposes of presenting a brief and clear description of the present invention, the preferred embodiment will be discussed as used for illuminating and viewing an object or target in a generally hard to access location, such as a behind a wall, within a conduit, or within a body of a vehicle, to illuminate the object, free from an umbra or shadow generated by the flashlight. The figures are intended for representative purposes only and should not be considered to be limiting in any respect.

Figure 2:
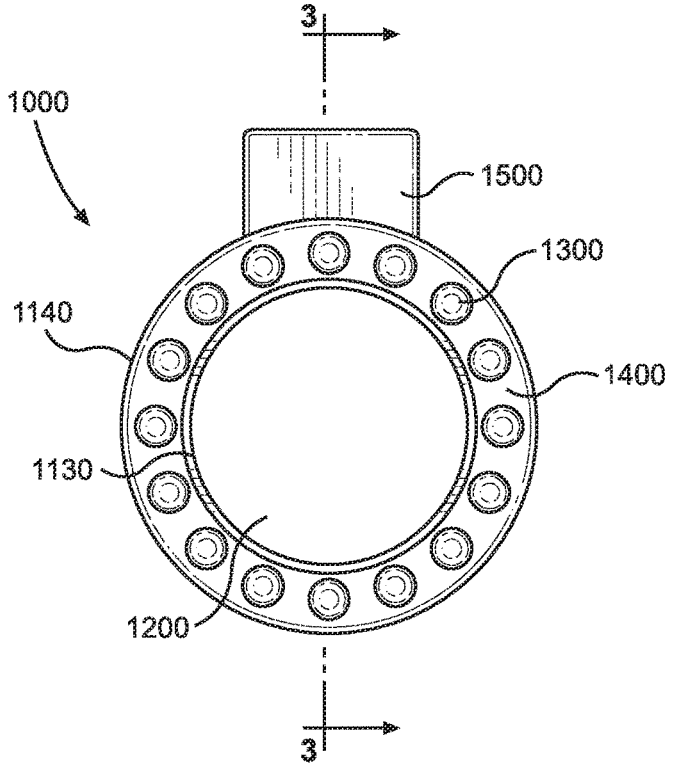
FIG. 2 shows a front-end view of the first embodiment of the flashlight as viewed from line 2-2 of FIG. 1.

Referring now to FIGS. 1 and 2, there is shown a view of a first embodiment of the flashlight and a front-end view of the first embodiment of the flashlight as viewed from line 2-2 of FIG. 1, respectively. The flashlight 1000 provides a device that is selectively activated and targeted to an object for illumination. The flashlight 1000 comprises a housing 1100 having an inner side 1130 forming a channel 1200 that extends between a first end 1110 of the housing and a second end 1120 of the housing. In the shown embodiment, the housing 1100 includes a generally tubular shape that is sized and adapted for handling and portable lighting. The channel 1200 extends along a longitudinal axis of the housing 1100 extending between the first end and the second end 1110, 1120. The channel 1200 is adapted to provide a monocular view therethrough, such that a user has a view extending from the first end 1110 of the housing 1100 through the forwardmost portion of the second end 1120 and ultimately to the desired target.

The flashlight 1000 includes one or more light sources 1300 for projecting one or more rays of light at the desired target at some distance from the flashlight 1000. In the shown embodiment, the one or more lights 1300 are oriented forward to project light from the second end 1120 of the housing 1100. Further, the one or more light sources 1300 are located at fixed intervals, so as to provide multiple point sources of light being directed at the target. In an alternative embodiment, the one or more light sources include a single light, such as an LED tube disposed circumventally about the second end 1120. In one embodiment the one or more lights are disposed within a transparent lighting housing. In an alternative embodiment, each of the one or more lights remain separate and outside a singular lighting housing, as shown in FIGS. 1 and 2.

In the shown embodiment, the housing 1100 encloses a power supply housing 1500 located on the exterior of the housing 1100, wherein a power supply 1550 is adapted to be removable therefrom and wherein the power source 1150 is operably connected to the one or more lights. In one embodiment, the power supply 1550 is a battery that provides electrical energy to the one or more light sources. An alternative embodiment, the power supply 1550 may include a solar panel and assembly, or a mechanical regenerative system. A control 1600 is operably connected to a power supply, such that the control 1600 governs that activation and deactivation of the one or more light sources. In one embodiment, the control 1600 is a switch that is selectively activated and deactivated to control the one or more light sources. The control 1600 may include an automatic detecting and automation, remote control, a timer mechanism for providing a limited activation period, and the like.

In the shown embodiment, the housing 1100 is generally tubular having a circular inner and outer cross section, as seen in FIG. 2. In one embodiment, the housing 1100 includes a bulbous second end 1120. The bulbous second end 1120 provides additional space for some of the components of the flashlight 1000, such as the one or more lights 1300 and corresponding electrical wiring and connections, so as to maintain a channel 1200 having sufficient diameter for viewing therethrough. In one embodiment, the housing 1100 comprises opaque material so as to not allow passage of a substantial amount of light from passing therethrough and entering the channel 1200.

Figure 3:
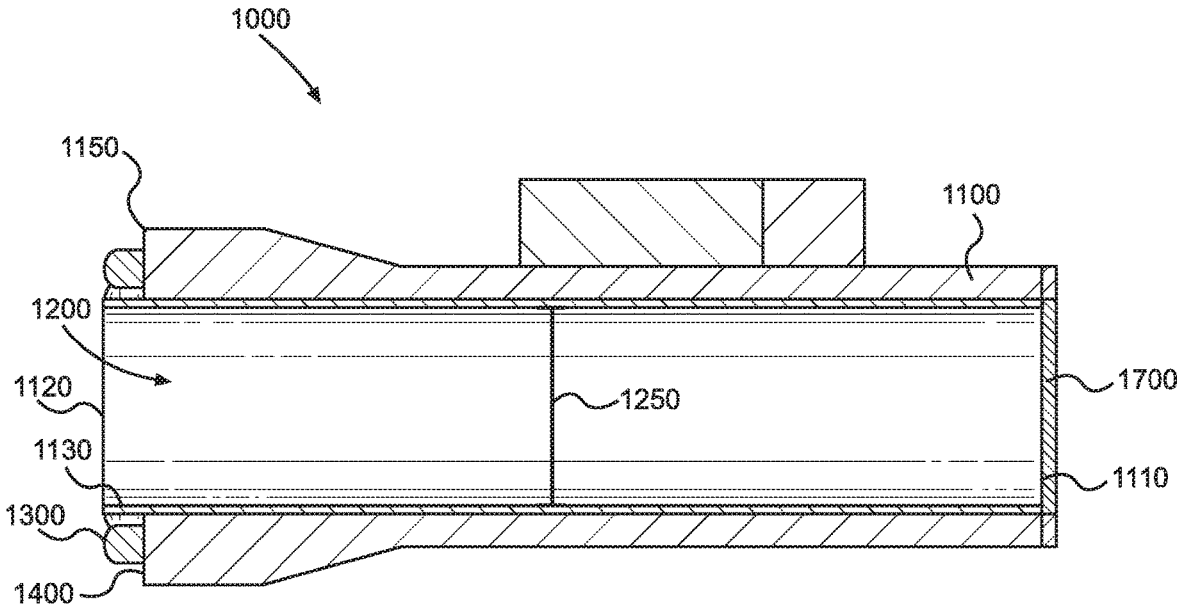
FIG. 3 shows a cross sectional view of the first embodiment of the flashlight taken along line 3-3 of FIG. 2.

Referring now to FIG. 3, there is shown a cross sectional view of the first embodiment of the flashlight taken along line 3-3 of FIG. 2. In the shown embodiment of the flashlight 1000, the inner side 1130 of the housing 1100 forms the channel 1200. The inner side 1130 extends past a forwardmost edge 1150 of an outer side 1140 of the housing 1100 at the second end 1120 forming a shoulder 1400 extending about the housing 1100. The shoulder 1400 includes an L-shape formed by the inner side 1130 of the housing 1100 and the forwardmost edge 1150. In one embodiment, the forwardmost edge 1150 is perpendicular to the inner side 1130.

In the shown embodiment, the one or more lights 1300 are disposed on the shoulder 1400, wherein the shoulder 1400 extends annularly about the second end 1120 of the housing 1100. In another embodiment, the shoulder 1400 extends about the perimeter of the second end 1120, wherein the second end 1120 has a rectangular shape, elliptical shape, and the like.

In the shown embodiment, the one or more light sources 1300 are disposed at fixed intervals and entirely about the shoulder 1400. In this way, the one or more light sources 1300 do not project light into the channel 1200, as the inner side 1130 of the housing 1100 that extends past the forwardmost edge 1150 of an outer side 1140 blocks the light. Additionally, in the shown embodiment, the one or more lights 1300 are radially offset from a forwardmost edge 1135 of the inner side 1130 of the channel 1200, wherein an uninterrupted ray of light is made to illuminate an object or target, free from an umbra or shadow generated by the flashlight 1000.

In the shown embodiment, a lens 1700 is disposed within the channel 1200. In one embodiment, the lens 1700 is located at the first end 1110. However, in alternative embodiments, the lens 1700 is positioned at any point within the channel 1200 between the first end and the second end 1110, 1120. In one embodiment, the lens 1700 includes two or more lens that operate in conjunction to enhance the target from a viewing perspective. In one embodiment, the lens 1700 is configured to provide ocular magnification of an object at a predetermined distance.

In the shown embodiment of FIG. 3, the housing 1100 includes a bulbous second end 1120, such that the outer side 1140 of the housing 1100 tapers between the second end 1120 to the first end 1100. Additionally, the channel 1200 comprises a uniform diameter 1250 extending the entire longitudinal length between the first end and the second end 1110, 1120.

Figure 4:
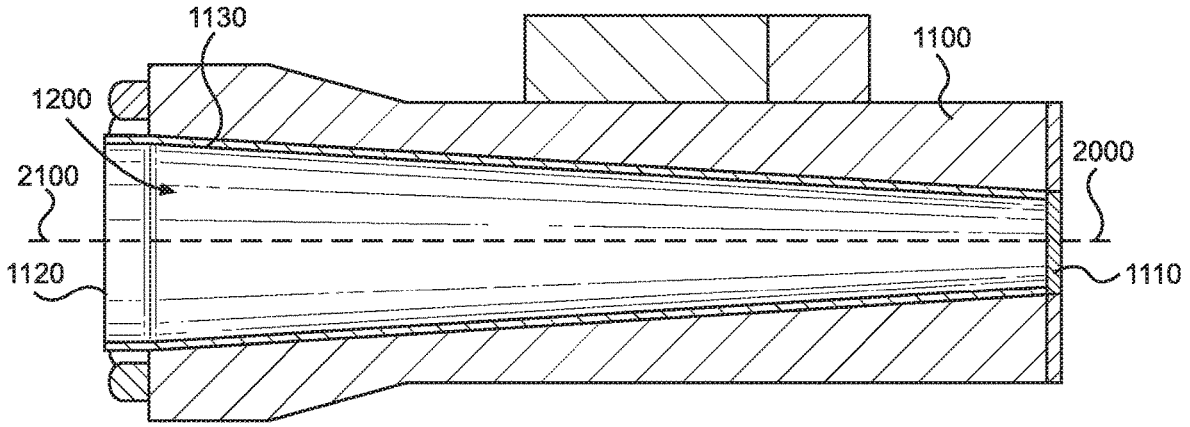
FIG. 4 shows a cross sectional view of an alternative embodiment of the flashlight.

Referring now to FIG. 4, there is shown a cross sectional view of an alternative embodiment of the flashlight. In the shown embodiment, the channel is entirely void of a lens and provides an unobstructed and unmagnified view through the channel. The inner side 1130 of the channel 1200 is tapered between the first end and the second end 1110, 1120. In one embodiment, the taper extends between the second end and the first end 1120, 1110, respectively. In this way, the viewing perspective at the first end 1100 may have a relative increased or decreased viewing angle of the object or target.

Referring now to FIGS. 3 and 4, the channel 1200 is centrally disposed in the housing 11, such that a channel central longitudinal axis 2000 is coincident with a housing central longitudinal axis 2100. In this way, the thickness of the housing 1100 is generally uniform therearound. In an alternative embodiment, the channel 1200 is offset from the housing, such that the channel central longitudinal axis 2000 is non-coincident with the central longitudinal axis 2100 (not shown).

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flashlight, comprising:

a housing having an inner side forming a channel, the channel extending between a first end of the housing and a second end of the housing;

one or more light sources are oriented forward to project light from the second end of the housing;

wherein the channel is adapted to provide a monocular view therethrough extending along the first end of the housing and the second end of the housing, wherein the inner side of the housing extends past a forwardmost edge of an outer side of the housing at the second end forming a shoulder extending about the housing;

wherein the one or more lights are disposed on the shoulder.

2. The flashlight of claim 1, wherein the one or more light sources are disposed on the second end of the housing.

3. The flashlight of claim 1, wherein the shoulder extends annularly about the second end of the housing.

4. The flashlight of claim 3, wherein the one or more light sources are disposed at fixed intervals and entirely about the perimeter of the shoulder.

5. The flashlight of claim 4, wherein the one or more lights are radially offset from a forwardmost edge of the inner side of the channel, wherein an uninterrupted ray of light is made to illuminate an object, free from an umbra or shadow generated by the flashlight.

6. The flashlight of claim 1, wherein the housing is tubular having a circular inner and outer cross section.

7. The flashlight of claim 1, wherein the channel comprises a uniform diameter extending between the first end and the second end.

8. The flashlight of claim 1, wherein the housing includes a bulbous second end.

9. The flashlight of claim 1, wherein the housing includes a power source operably connected to the one or more lights.

10. The flashlight of claim 1, wherein the channel is entirely void of a lens and provides an unobstructed and unmagnified view through the channel in operation.

11. The flashlight of claim 1, further comprising a lens configured to provide ocular magnification of an object at a predetermined distance.

12. The flashlight of claim 1, wherein the housing comprises opaque material so as to not allow passage of a substantial amount of light from entering the channel.

13. The flashlight of claim 1, wherein the outer side of the housing tapers between the second end to the first end.

14. The flashlight of claim 1, wherein the housing comprises an activation switch configured to control the one or more lights.

15. The flashlight of claim 1, wherein the channel is centrally disposed in the housing, such that a central longitudinal axis of the channel is coincident with a longitudinal axis central longitudinal axis of the housing.

* * * * *